US006562155B1

(12) United States Patent
Mikubo et al.

(10) Patent No.: US 6,562,155 B1
(45) Date of Patent: May 13, 2003

(54) PROCESS FOR PRODUCING ALUMINUM ALLOY SEMI-MOLTEN BILLET FOR USE AS TRANSPORTATION UNIT

(75) Inventors: Shigeru Mikubo, Fukuoka (JP); Masafumi Mizouti, Fukuoka (JP); Yasuyuki Murayama, Fukuoka (JP); Tsunaki Iwashita, Fukuoka (JP); Akihiko Kamio, Tokyo (JP); Tatsuo Sato, Tokyo (JP)

(73) Assignee: Kyusyu Mitsui, Aluminum Co., Ltd., Fukuoka (JP)

( * ) Notice: Subject to any disclaimer, the term of this patent is extended or adjusted under 35 U.S.C. 154(b) by 0 days.

(21) Appl. No.: 09/665,210

(22) Filed: Sep. 18, 2000

(30) Foreign Application Priority Data

May 8, 2000 (JP) ..... 2000-134845

(51) Int. Cl.[7] ..... C22F 1/043; B22C 9/00

(52) U.S. Cl. ..... 148/552; 148/695; 164/120; 164/900

(58) Field of Search ..... 148/552, 695; 164/120, 900

(56) References Cited

U.S. PATENT DOCUMENTS 4,415,374 A * 11/1983 Young et al. ..... 148/2
5,133,811 A * 7/1992 Kirkwood et al. ..... 148/95
5,536,337 A * 7/1996 Wei ..... 148/549

* cited by examiner

*Primary Examiner*—George Wyszomierski
*Assistant Examiner*—Janelle Combs Morillo
(74) *Attorney, Agent, or Firm*—Jordan and Hamburg LLP

(57) ABSTRACT

A process for producing an aluminum alloy semi-molten billet for use as a transporation unit, including the steps of: producing an aluminum alloy having a composition consisting essentially of, in weight %, 0.5 or less Cu, 5.0 to 10.0 Si, 0.2 to 0.7 Mg, 0.35 or less Zn, 0.55 or less Fe, 0.5 or less Mn, 0.005 to 0.5 Ti, and the balance aluminum; introducing working strain into a melt of the aluminum alloy by means of molding flask-assisted cold forging at a distortion rate of 10 to 40%, at a working introduction velocity of 10 mm or less per second, and at a temperature of 200° C. or lower; and, thereafter heat-treating such a strain introduced melt at temperatures in a range of 576 to 585° C.

8 Claims, 7 Drawing Sheets

PROCESS FOR PRODUCING ALUMINUM ALLOY SEMI-MOLTEN BILLET FOR USE AS TRANSPORTATION UNIT

BACKGROUND OF THE INVENTION

This invention relates to a process for producing an aluminum alloy semi-molten billet for use as a transportation unit.

Thixocasting using a semi-molten billet is an art having recently attracted considerable attention because of its advantages in which less segregation and fewer defects of casting as well as a longer service life of a mold are available when compared with conventional die-casting. There are several different processes for producing the billet. One of them is system "A" known as the Pechiney Alumax System in which a melt is electromagnetically and mechanically agitated at a semi-melting temperature in order to provide spheroidized primary crystals α (Al) at a billet-producing stage. Another process is system "B" in which a compound of Al—Ti—B is added to a melt during casting in amounts greater than when usually added, and then the melt is heated up to a semi-melting temperature range, thereby yielding spheroidized primary crystals α (Al).

A further process is system "C" in which strain is introduced into a melt by means of extrusion/rolling, and the melt is thereafter heated up to a semi-melting temperature range so as to provide spheroidized primary crystals α (Al) as practiced in the above system "B."

Such conventional processes for producing the semi-molten billet suffer from various problems. For example, system "A" results in a very complicated process of manufacture, and adds to manufacturing cost. System "B" involves addition of a large quantity of Al—Ti—B, and then $TiB_2$ settles down in a melting furnace, with consequential instability of casting quality. In system "C", for strain to be introduced into the melt by means of rolling, uniform strain is difficult to provide. For strain to be introduced into the melt by means of extrusion, such extrusion usually involves a complicated manufacturing process, and further encounters a difficulty of introducing even strain into the melt. Moreover, these two methods for introducing the strain into the melt in system "C" require machining a worked product. This requirement hinders mass production and is a cost drawback.

SUMMARY OF THE INVENTION

In view of the above, an object of the present invention is to provide a process for producing an aluminum alloy semi-molten billet for use as a transportation unit, whereby a simpler manufacturing process and lower cost are realized, with the result that products of uniform quality are available. The above object is achievable by the foregoing process according to the present invention, the process including the steps of: producing an aluminum alloy having a composition consisting essentially of, in weight %, 0.5 or less Cu, 5.0 to 10.0 Si, 0.2 to 0.7 Mg, 0.35 or less Zn, 0.55 or less Fe, 0.5 or less Mn, 0.005 to 0.5 Ti, and the balance aluminum, introducing working strain into a melt of the aluminum alloy by means of molding flask-assisted cold forging at a strain percentage of 10 to 40%, at a working introduction velocity of 10 mm or less per second, and at a temperature of 200° C. or lower; and, thereafter retaining such strain introduced melt at temperatures in a range of 576 to 585° C.

DETAILED DESCRIPTION OF THE PREFERRED EMBODIMENTS

Figure 1:
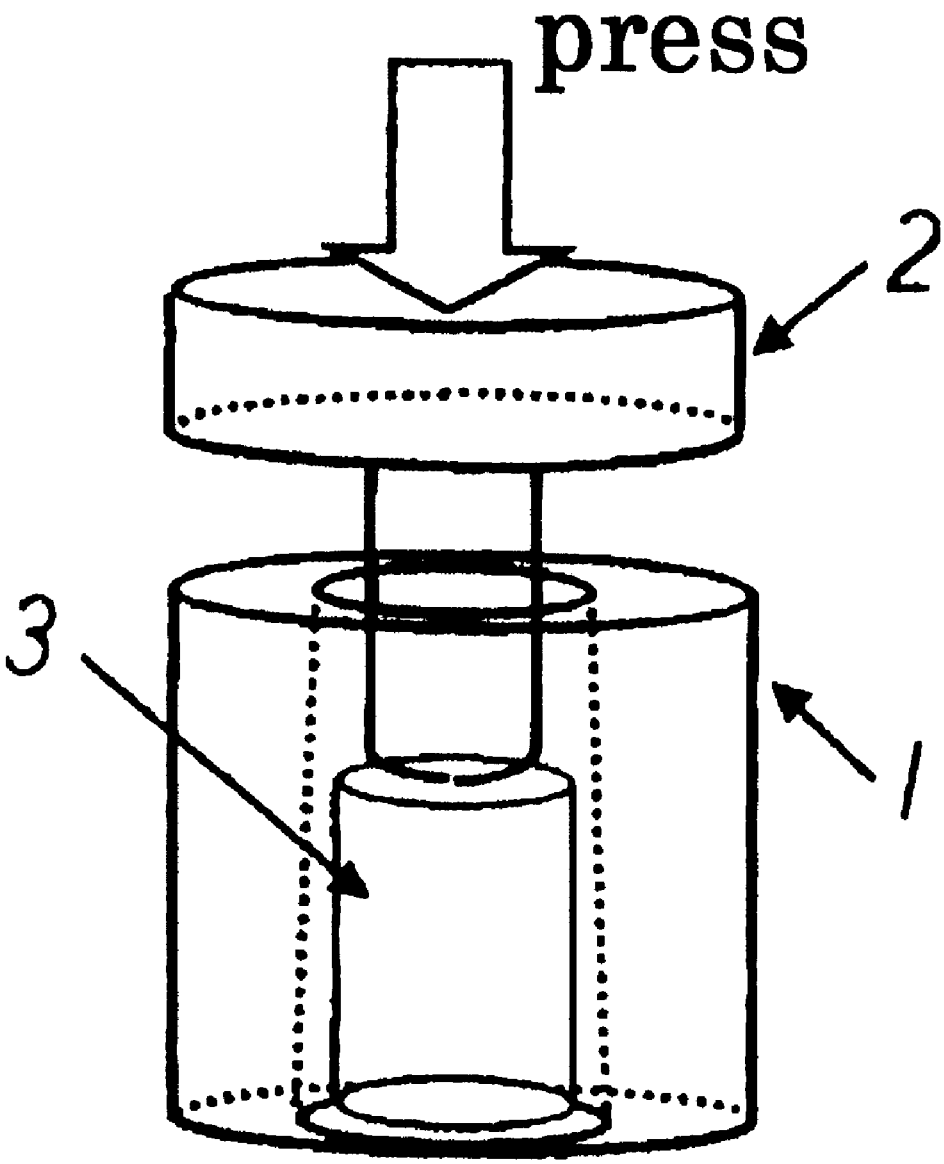
FIG. 1 is a simulative illustration, showing molding flask-assisted cold forging.

Initially, reasons for various numeric limitations such as numeric limitations in a table of constituents of an aluminum alloy according to the present invention will be described in detail.

Cu is a constituent operative to maintain resistance to stress, corrosion, and cracking. However, Cu is less resistant to corrosion when being present in an amount greater than 0.5 weight %. Therefore, the Cu content was limited to 0.5 weight % or less.

Constituent Si provides good fluidity of a melt in casting, improved cracking and shrinkage of the alloy, and improved abrasion resistance of the alloy, but is less operative when being in an amount less than 5.0 weight %. However, Si in an amount more than 10.0 weight % detracts from the elongation and toughness of the aluminum alloy, and results in less casting workability of the alloy. Therefore, the Si content was limited to 5.0–10.0 weight %.

Constituent Mg precipitates $Mg_2Si$, and contributes toward enhancement in strength of the alloy, but is less operative when being present in an amount less than 0.2 weight %. However, Mg in an amount more than 0.7 weight % precipitates an excessive amount of $Mg_2Si$ and brings about a reduction in toughness of the alloy. Therefore, the Mg content was limited to 0.2 to 0.7 weight %.

Ingredient Zn degrades the corrosion resistance of the alloy. Thus, the Zn content was limited to at most 0.35 weight %.

Composition Fe causes Al—Fe—Si series compounds, and adversely affects the elongation, toughness and corrosion resistance of the alloy. However, Fe in an amount of 0.55 weight % or less exercises substantially no adverse influence on them.

Composition Mn restrains recystallization coarsening of the alloy in solution heat-treated and artificially aged, and improves the strength, elongation, and toughness of the alloy. However, Mn in an amount of greater than 0.5 weight increases brittle intermetallic compounds in Al—Fe—Si—Mn series compounds, and thus adversely affects the workability of the alloy. Therefore, the Fe content was limited to 0.5 weight % or less.

Ingredient Ti causes a structure of an ingot to be made fine, and then prevents the ingot from experiencing cracking, but is less operative when being present in an amount less than 0.005 weight %. However, Ti in an amount greater than 0.5 weight % aids in generating large crystallized objects such as $TiB_2$ or $TiAl_3$, which are responsible for cracking during casting work. Therefore, the Ti content was limited to 0.005–0.5 weight %.

Composition Na causes eutectic Si to be made fine, and then improves an impact value and elongation, but is less operative when being present in an amount less than 0.003 weight %. Meanwhile, Na in an amount greater than 0.01 weight % results in reductions in fluidity and degassing. Therefore, the Na content was limited to 0.003–0.01% by weight.

Constituent Sb also makes eutectic Si fine, but is insufficient to exhibit such an effect when being present in an amount less than 0.05 weight %. Meanwhile, Sb in an amount greater than 0.2 weight % reduces the toughness of the alloy. Therefore, the Si content was limited to 0.05–0.2% by weight.

Composition Sr causes eutectic Si to be made fine, and then improves an impact value and elongation, but is less operative when being present in an amount less than 0.005 weight %. Meanwhile, Sr in an amount greater than 0.03 weight % results in a reduction in processability as well as contamination of gases and inclusions. Therefore, the Sr content was limited to 0.005–0.03% by weight.

Working strain is introduced into a melt by means of forging in order to provide a simplified manufacturing process and further to permit a worked product to require less molding. In addition, such forging is practiced by way of cold forging in order to introduce the strain into the melt at a lower working rate. Furthermore, such cold forging is conducted by way of molding flask-assisted forging so as to permit uniform strain to be led into the entire product.

When a strain percentage is less than 10%, then less strain is introduced into the melt. As a result, non-uniformly spheroidized primary crystals α are yielded, even when the melt is heated up to a semi-melting temperature range. Meanwhile, when the strain percentage is greater than 40%, then an ingot is cracked during cold forging. In addition, no change in size of primary crystals α is observed. Therefore, the strain percentage was limited to 10–40% by weight.

When a working introduction rate is greater than 10 mm per second, then the ingot is cracked during forging. In addition, a forging dead zone tends to occur. Thus, the working introduction rate was limited to 10 mm per second.

When a temperature of a billet during molding flask-assisted cold forging exceeds 200° C., then the strain is insufficiently led into the billet at a predetermined working rate, with the result of non-granularly structured primary crystals α and a complicated manufacturing process. Therefore, the temperature was limited to 200° C. or less.

When a heat treating temperature in a semi-melting temperature range is less than 576° C., then primary crystals a are not spheroidized, resulting in a portion of the melt in which grown eutectic Si have not been molten. When the heat treating temperature is greater than 585° C., then the alloy is molten, and cannot be molded into billets. Therefore, the heat treating temperature was limited to 576–585° C.

EXAMPLE

A specific embodiment of the present invention will now be described.

FIG. 1 is a simulative illustration, showing molding flask-assisted cold forging according to the present invention. In this figure, reference numeral 1 denotes a forging metal mold; 2 a forging metal mold punch; and, 3 an aluminum alloy billet.

The aluminum alloy billet was cast by a continuous casting, in which molten metal is prepared so as to provide respective compositions consisting of Cu, Si, Mg, Zn, Fe, Mn, Sr, and Ti, as illustrated in Table 1 that follows:

TABLE 1

| | wt % | | | | | | | |
|---|---|---|---|---|---|---|---|---|
| No. | Cu | Si | Mg | Zn | Fe | Mn | Sr | Ti |
| 1 | 0.002 | 7.0 | 0.40 | 0.004 | 0.09 | 0.002 | 0.001 | 0.01 |
| 2 | 0.002 | 7.1 | 0.40 | 0.005 | 0.09 | 0.002 | 0.010 | 0.01 |
| 3 | 0.002 | 6.9 | 0.38 | 0.005 | 0.10 | 0.002 | 0.010 | 0.15 |

Figure 2:
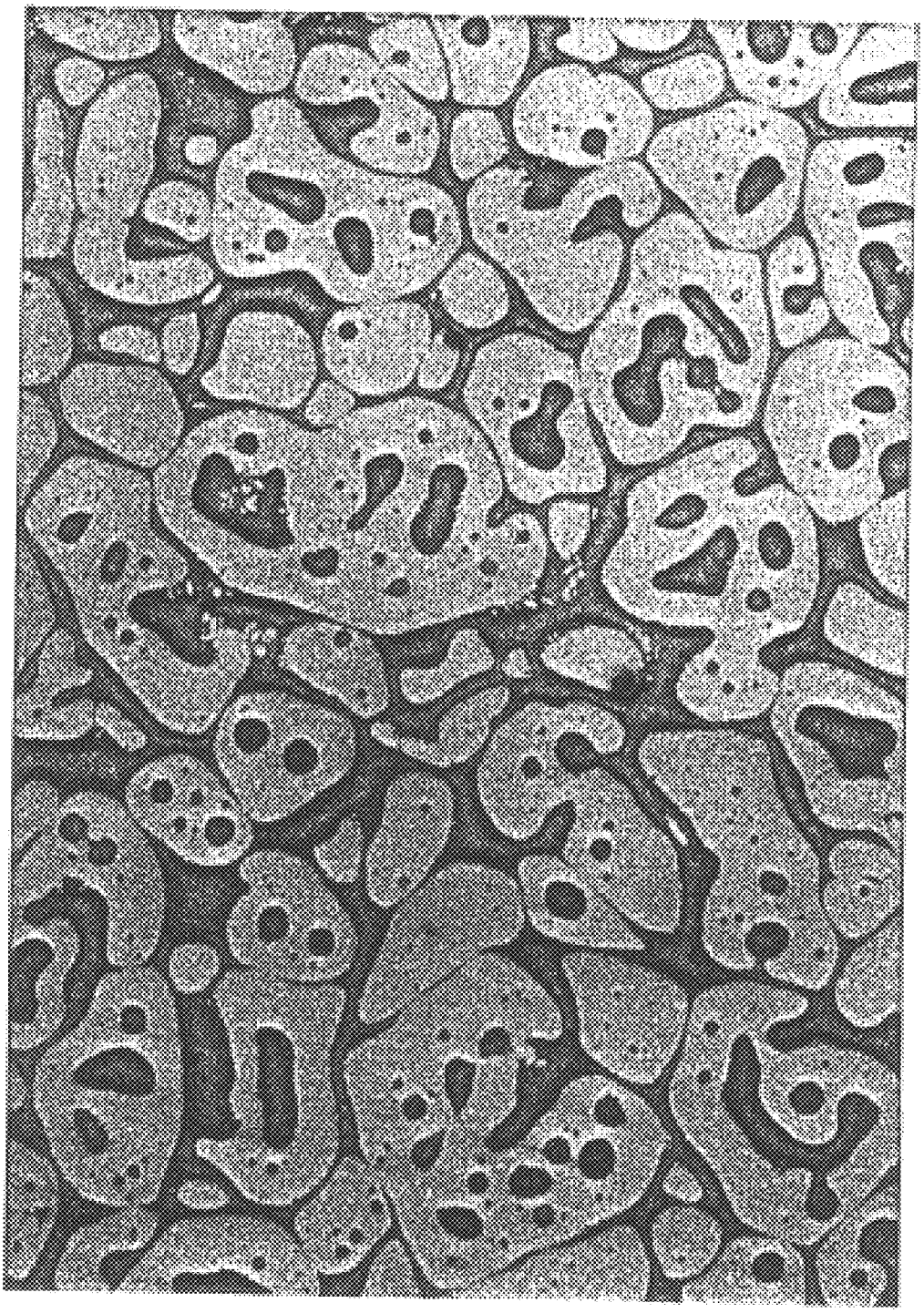
FIG. 2 is an illustration, showing a microstructure photograph of an article heat-treated in a semi-melting temperature range after cold free forging, in which the photograph has a magnifying power of 92.

FIG. 2 illustrates a microstructure photograph of an article heat-treated in a semi-melting temperature range after cold free forging. For free cold forging, part of a melt is observed to contain non-spheroidized primary crystals α, even when the melt is heat-treated to the semi-melting temperature range.

Figure 3:
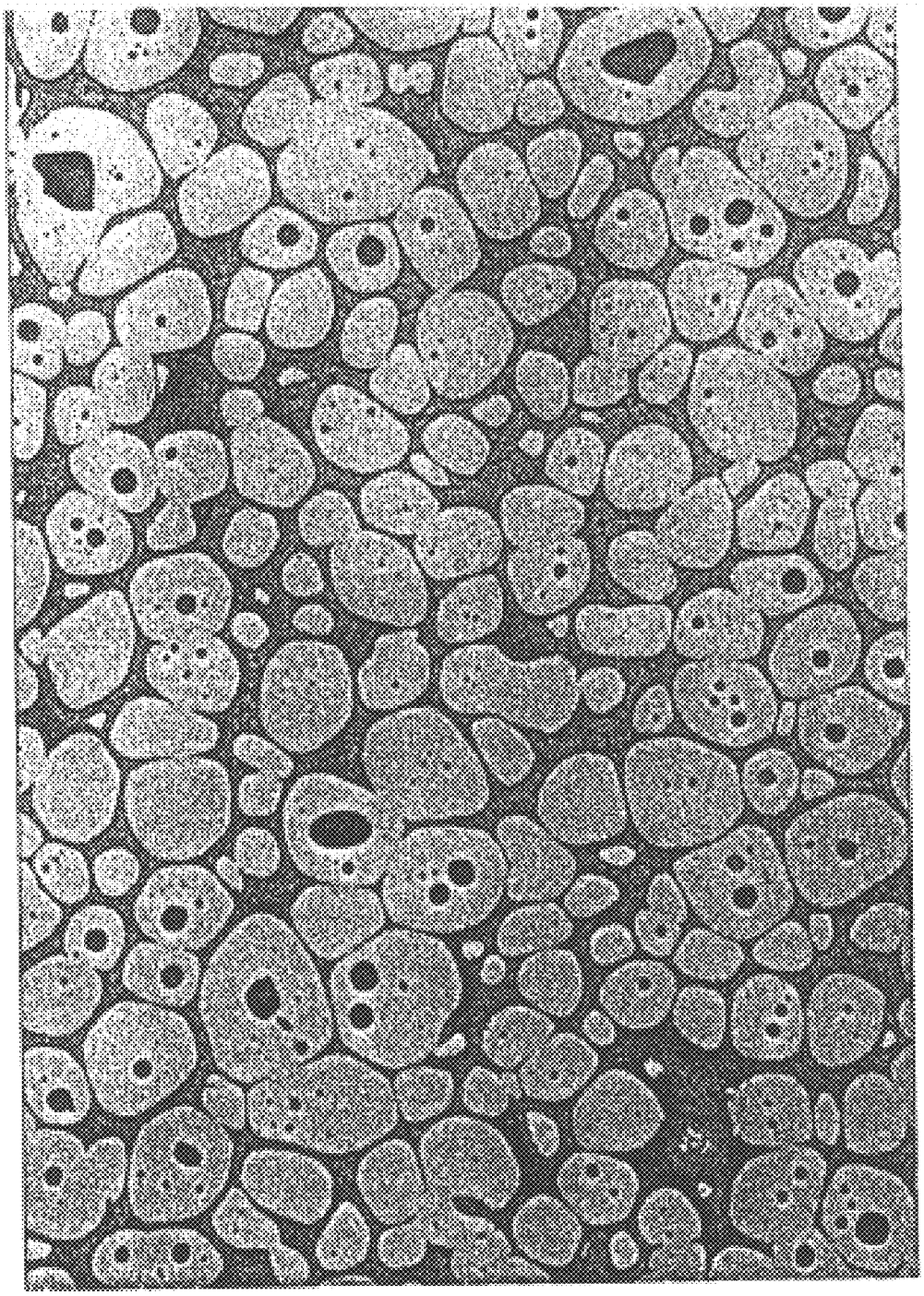
FIG. 3 is an illustration, showing a microstructure photograph of an article heat-treated in a semi-melting temperature range after molding flask-assisted cold forging, in which the, photograph has a magnifying power of 92.

FIG. 3 illustrates a microstructure photograph of an article heat-treated in a semi-melting temperature range after molding flask-assisted cold forging. When the same strain percentage as that of free forging is introduced into a melt by means of the molding flask-assisted cold forging as illustrated in FIG. 1, and further when the melt is thereafter heat-treated to the semi-melting temperature range, then primary crystal α has a spheroidized structure formed at each portion of the melt.

Figure 4:
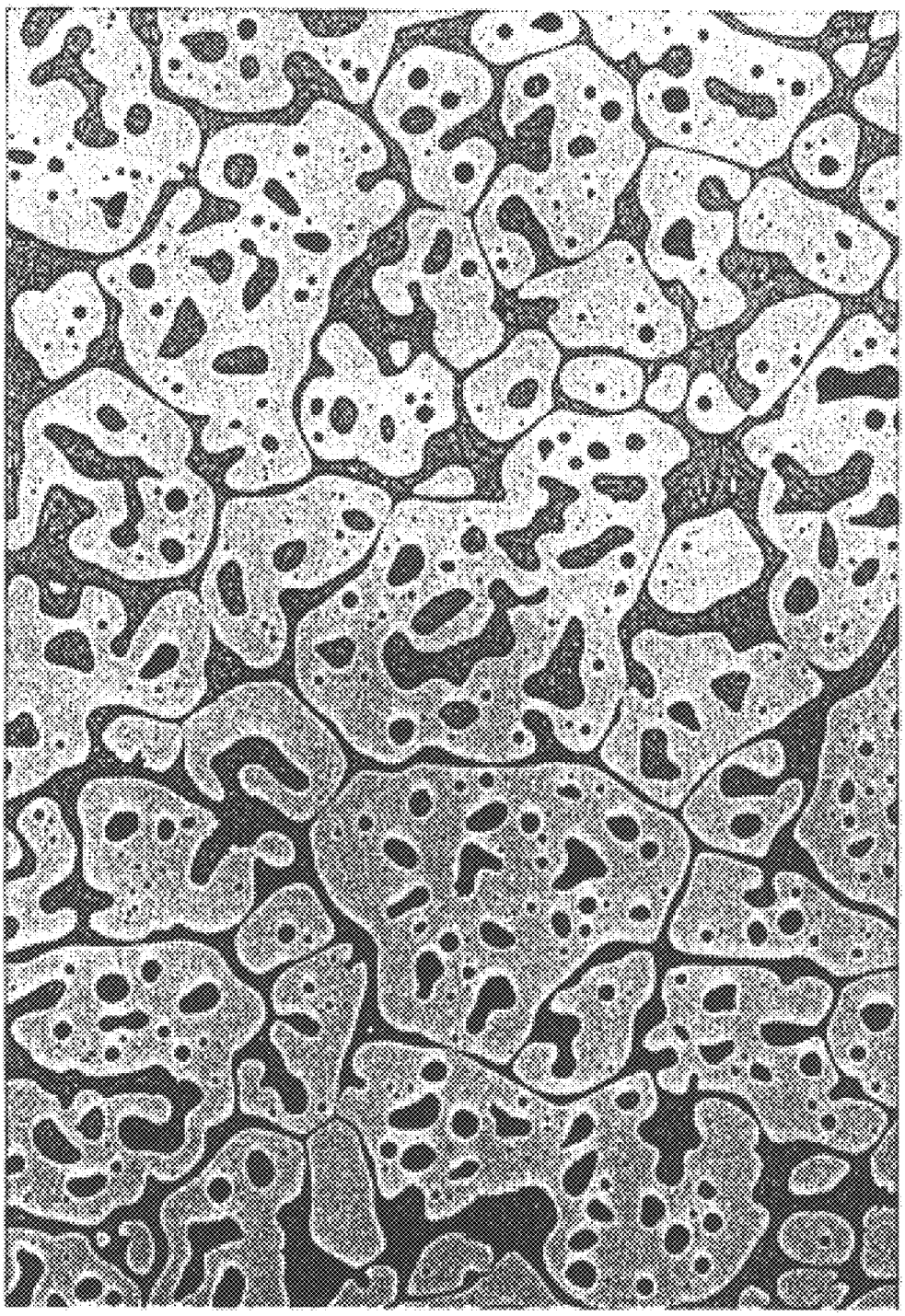
FIG. 4 is an illustration, showing a microstructure photograph of an article heat-treated in a semi-melting temperature range after molding flask-assisted cold forging, in which the heat-treated article has a strain percentage less than 10%, and further in which the photograph has a magnifying power of 92.

FIG. 4 illustrates a microstructure photograph of an article heat-treated to a semi-melting temperature range after molding flask-assisted cold forging, in which the article has a strain percentage less than 10%. Such a distortion rate causes insufficient distortion to be brought into dendrite, with the result of non-uniformly spheroidized primary crystals α.

Figure 5:
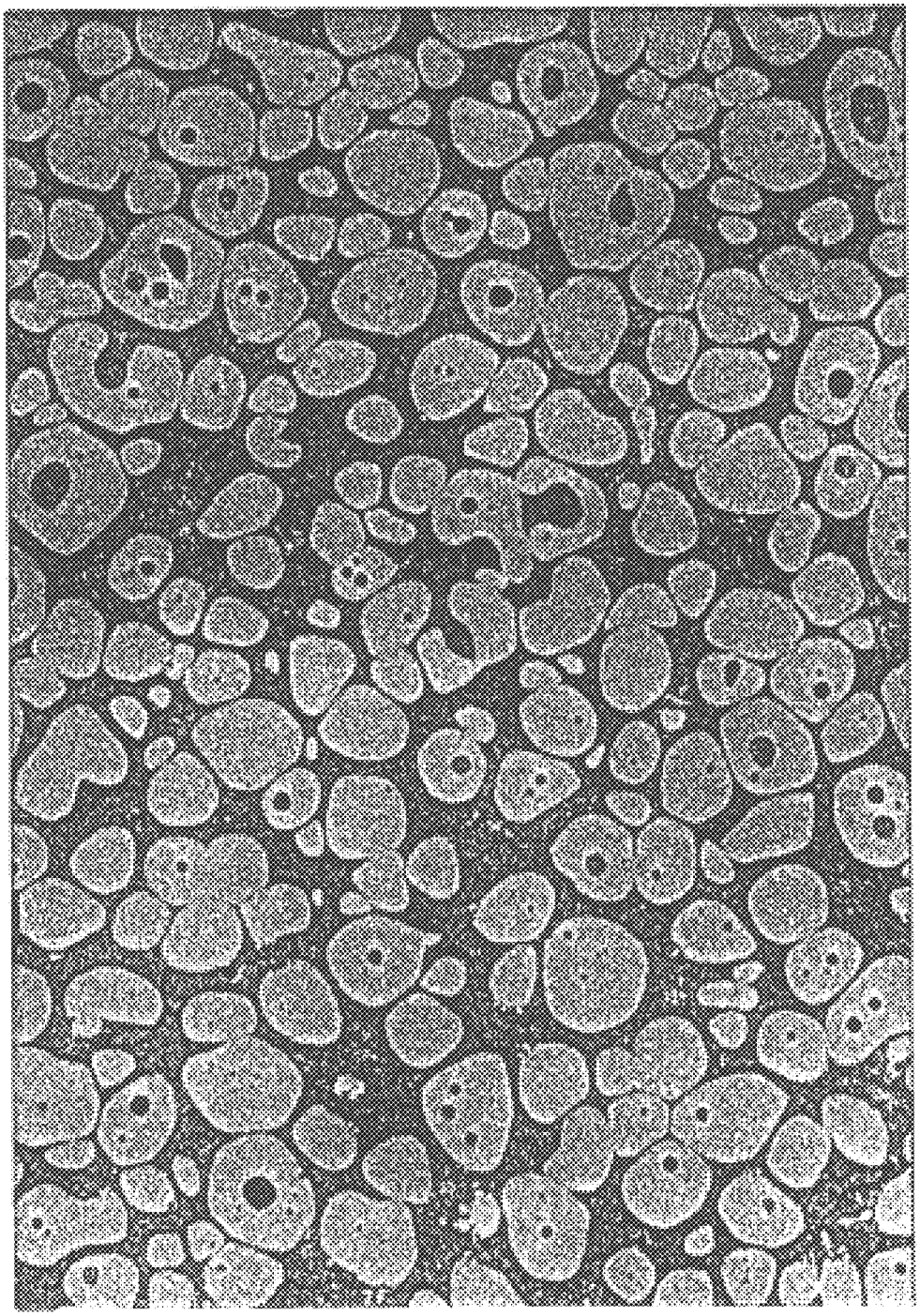
FIG. 5 is an illustration, showing a microstructure photograph of an article heat-treated in a semi-melting temperature range after molding flask-assisted cold forging, in which the heat-treated article has a strain percentage of 10 to 40%, and further in which the photograph has a magnifying power of 92.

FIG. 5 illustrates a microstructure photograph of an article heat-treated in a semi-melting temperature range after molding flask-assisted cold forging, in which the article has a strain percentage of 10 to 40%. In this instance, the heat-treated article is observed to uniformly undergo sufficient strain, and further to contain spheroidized primary crystals α having an average size of 100 μm. However, when the strain percentage is greater than 40%, then forged billets are cracked.

Figure 6:
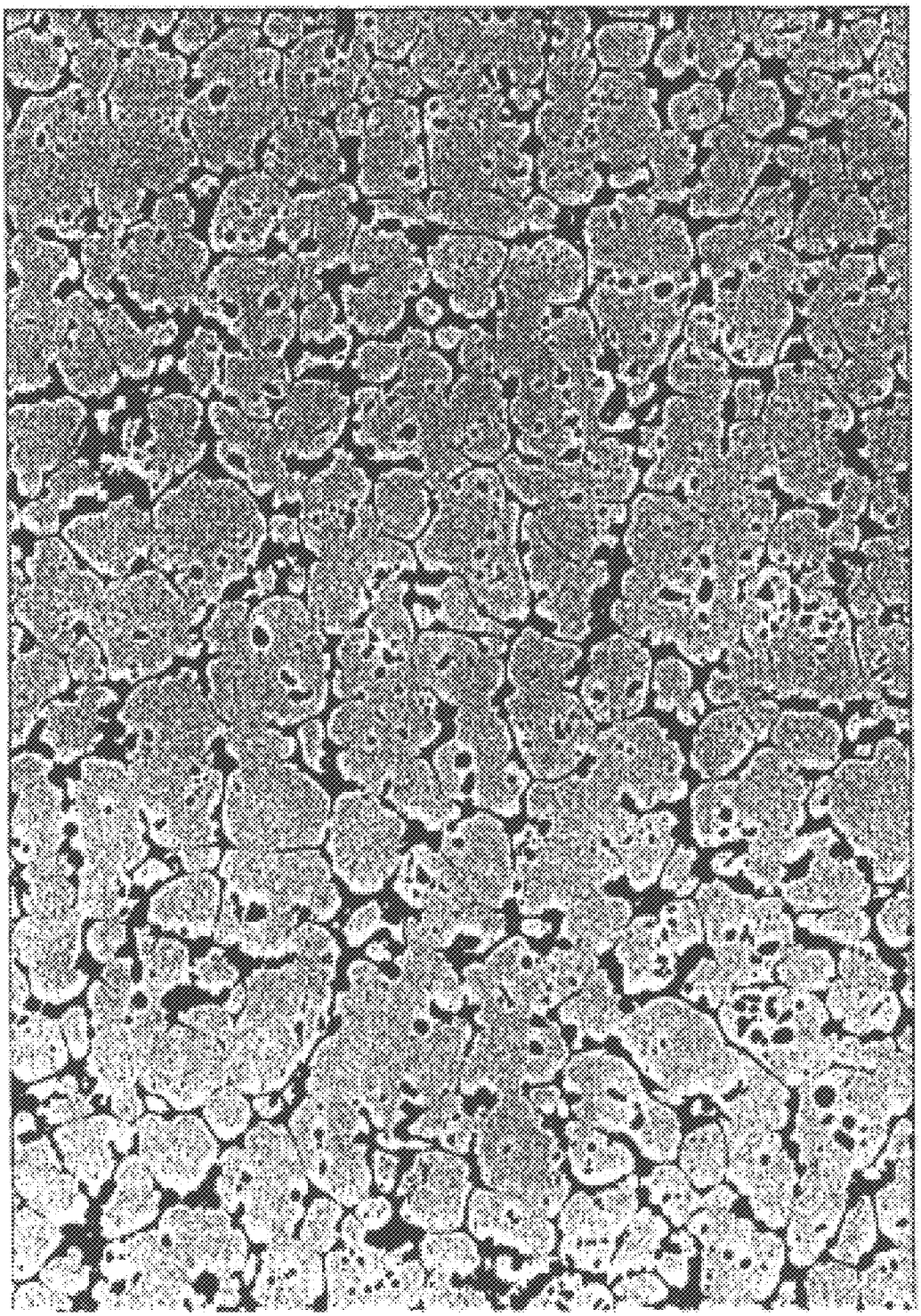
FIG. 6 is an illustration, showing a microstructure photograph of an article heat-treated at a temperature less than 576° C. after molding flask-assisted cold forging, in which the photograph has a magnifying power of 92; and, FIG. 7 is an illustration, showing a microstructure photograph of an article heat-treated at a temperature of 576 to 585° C. after molding flask-assisted cold forging, in which the photograph has a magnifying power of 92.
Figure 7:
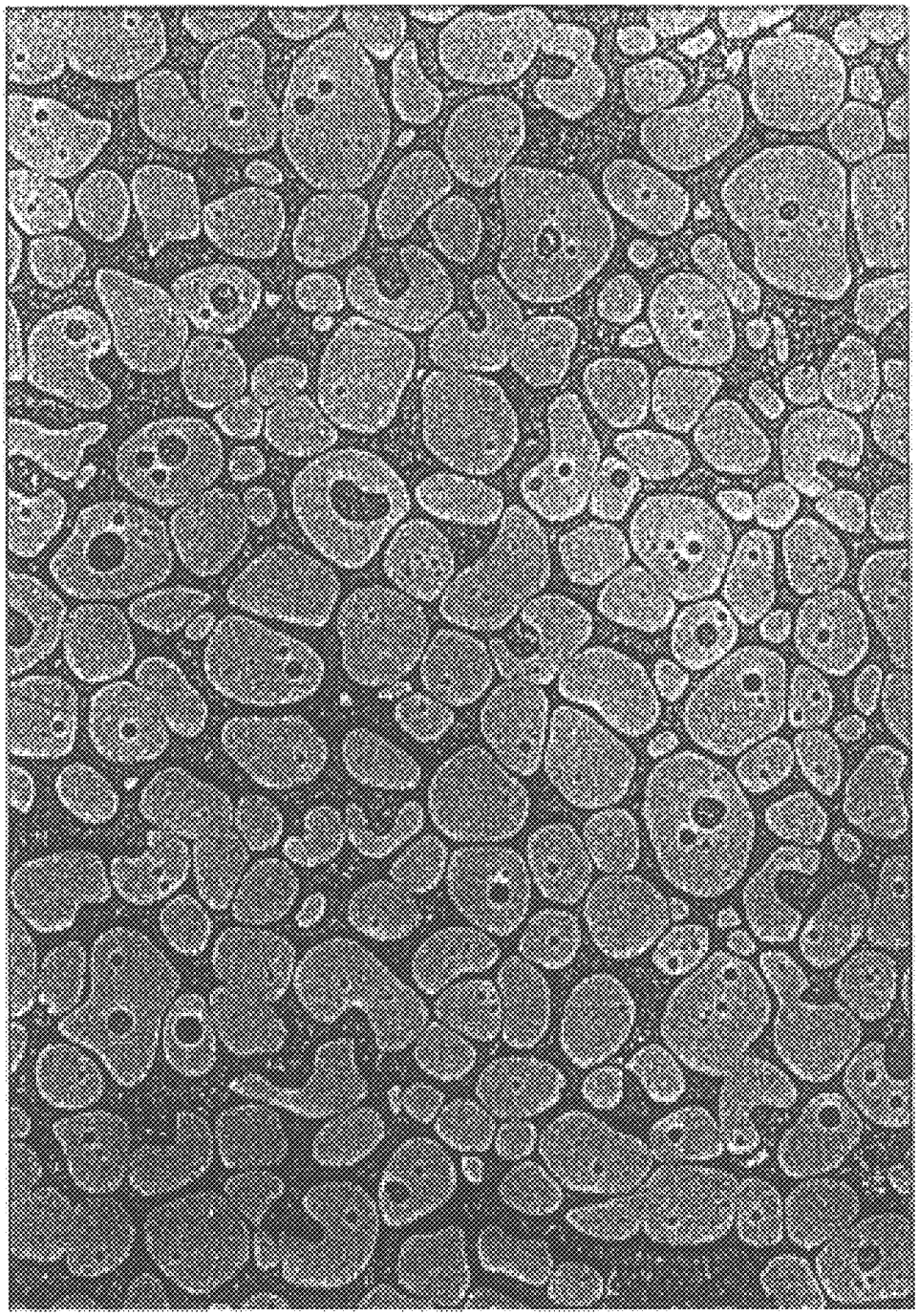

FIG. 6 illustrates a microstructure photograph of an article heat-treated at a temperature below 576° C. after molding flask-assisted cold forging. In this case, such a temperature is rather lower than an Al—Si two-dimensional eutectic temperature, and a portion of the melt is observed to contain non-molten eutectic Si. In addition, primary crystals α are formed into non-spheroidized structures. Meanwhile, in an article heat-treated at a temperature of 576 to 585° C. after molding flask-assisted cold forging as illustrated in FIG. 7, primary crystals a are formed into substantially fully spheroidized structures. However, when such a heat-treating temperature is greater than 585° C. then billets are molten, and subsequent molding is difficult to achieve.

As previously described, the process for producing the aluminum alloy semi-molten billet according to the present invention provides a simpler manufacturing process and lower cost, when compared with any conventional process.

Furthermore, the process for producing the aluminum alloy semi-molten billet according to the present invention provides uniformly spheroidized primary crystals α which are structured to have an average size of 100 μm and an area percentage of 50%. Such a billet attained by the process according to the present invention is usable as a transportation unit such as an automobile component.

What is claimed is:

1. A process for producing an aluminum alloy product consisting essentially of the steps of:

a) preparing an aluminum alloy having a composition consisting essentially of, in weight percent relative to the aluminum alloy produced, 0.5 or less Cu, 5.0 to 10.0 Si, 0.2 to 0.7 Mg, 0.35 or less Zn, 0.55 or less Fe, 0.5 or less Mn, 0.005 to 0.5 Ti, and a balance of aluminum;

b) introducing strain into the aluminum alloy by molding by flask-assisted cold forging at a strain percentage of 10 to 40%, and at a temperature of 200° C. or less to thereby form an intermediate alloy product; and c) heat-treating the intermediate alloy product at a temperature in a range of 576 to 585° C. to convert said intermediate alloy product to the aluminum alloy product having a structure including generally uniformly spheroidized primary crystals.

2. The process according to claim 1 wherein the strain is introduced uniformly in the aluminum alloy.

3. The process according to claim 2 wherein the strain is introduced at a working introduction velocity of 10 mm or less per second.

4. The process according to claim 1 wherein the strain is introduced at a working introduction velocity of 10 mm or less per second.

5. A process for producing an aluminum alloy product consisting essentially of the steps of:

a) preparing an aluminum alloy having a composition consisting essentially of, in weight percent relative to the aluminum alloy produced, 0.5 or less Cu, 5.0 to 10.0 Si, 0.2 to 0.7 Mg, 0.3.5 or less Zn, 0.55 or less Fe, 0.5 or less Mn, 0.005 to 0.5 Ti, and at least one component in a weight percent relative to the aluminum alloy produced from the group consisting of 0.005 to 0.03 Sr, 0.003 to 0.01 Na, and 0.05 to 0.2 Sb, and a balance of aluminum;

b) introducing strain into the aluminum alloy by molding by flask-assisted cold forging at a strain percentage of 10 to 40%, and at a temperature of 200° C. or lower to thereby form an intermediate alloy product; and c) heat-treating the intermediate alloy product at a temperature in a range of 576 to 585° C. to convert said intermediate alloy product to the aluminum alloy product having a structure including generally uniformly spheroidized primary crystals.

6. The process according to claim 5 wherein the strain is introduced uniformly in the aluminum alloy.

7. The process according to claim 6 wherein the strain is introduced at a working introduction velocity of 10 mm or less per second.

8. The process according to claim 5 wherein the strain is introduced at a working introduction velocity of 10 mm or less per second.

* * * * *